US005352091A

United States Patent [19]

Sylvestro

[11] Patent Number: 5,352,091

[45] Date of Patent: Oct. 4, 1994

[54] GAS TURBINE AIRFOIL

[75] Inventor: Joseph A. Sylvestro, New Britain, Conn.

[73] Assignee: United Technologies Corporation, Hartford, Conn.

[21] Appl. No.: 177,488

[22] Filed: Jan. 5, 1994

[51] Int. Cl.[5] ..... F01D 5/18

[52] U.S. Cl. ..... 416/96 A; 416/97 R

[58] Field of Search ..... 416/96 A, 97 R

[56] References Cited

U.S. PATENT DOCUMENTS

| | | | |
|---|---|---|---|
| 3,628,885 | 12/1971 | Sidenstick et al. | 416/97 |
| 4,697,985 | 10/1987 | Suzuki | 416/97 R |
| 5,288,207 | 2/1994 | Linask | 416/97 R |

FOREIGN PATENT DOCUMENTS

| | | | |
|---|---|---|---|
| 364747 | 3/1973 | Japan | 416/96 A |
| 58197402 | 5/1982 | Japan . | |
| 47103 | 3/1983 | Japan | 416/96 A |

*Primary Examiner*—John T. Kwon

*Attorney, Agent, or Firm*—Edward L. Kochey, Jr.

[57] ABSTRACT

Tube 16 within airfoil 10 carries cooling air. Flow openings 28 in the tubes direct cooling air 29 against the airfoil inner surface 14. Protrusions 30 form extended surface in the form of segmented trip strips are located with segmented trip strips are located with at least same in registration with openings 28. The chamber 18 between the tube 16 and surface 14 has an increasing flow area toward air exit 20.

7 Claims, 1 Drawing Sheet

10
12
14
16
18
20
22
24
26
28
29
30
32
2
3
4

GAS TURBINE AIRFOIL

TECHNICAL FIELD

The invention relates to first stage airfoils for gas turbines requiring substantial air cooling, and in particular to an impingement cooling arrangement therefore.

BACKGROUND OF THE INVENTION

A high efficiency gas turbine engine requires high inlet gas temperatures to the turbine. Accordingly first stage vanes and blades are operating near the maximum temperature for which they may be designed.

These vanes and blades require cooling for long term survival. A common method is to use high pressure air from the compressor which is supplied internally to the vane or blade airfoils for cooling the structure.

Several methods for using this cooling air to cool the surface are known. Film cooling of the external surface is the achieved by permitting the air to exit through the surface in a controlled manner to flow along the outside film of the blade. Convection cooling of the internal surface is also used, with trip strips sometimes located to improve the heat transfer. Impingement cooling is also used by directing high velocity flow substantially perpendicular to the internal surface of the airfoil being cooled.

In Japanese Patent Application 58-197402(A) air is impinged on the internal wall of a blade at a location between projections. These projections extend from the internal surface of the blade wall the full height of the air passage.

SUMMARY OF THE INVENTION

A hollow tube is located within an airfoil spaced from the internal surface of the airfoil walls. This forms a flow chamber between the tubes and the internal surface. An air exit is located the trailing edge of the airfoil in fluid communication with the flow chamber. A plurality of flow openings in the hollow tube permit cooling air delivered into the center of the tube to pass through these openings, impinging against the interior surface of the airfoil and then flowing outwardly through the air exit. A plurality of extended surface protrusions are located on the internal surface with the flow openings being in registration with at least some of these protrusions.

Extended surface on the internal passage wall increases the surface area available for impingement cooling. An increase in internal surface area provides improved heat transfer from the passage wall. The relationship between heat transfer and surface area is demonstrated with the heat equation $Q=H\times A\times$delta T. Where, Q is the heat transferred, H is the heat transfer coefficient, A is the surface area, and delta T is the air to wall temperature difference. From review of the heat equation, as surface area (A) increases so does the heat transfer (Q) from the wall.

An additional benefit of extended surfaces occurs at locations remote from the air impingement when the extended surface take the form of trip strips. In these locations trip strips promote turbulence in the flow channel which in turn improves heat transfer.

DESCRIPTION OF THE PREFERRED EMBODIMENT

Figures 1, 2, 3, 4:
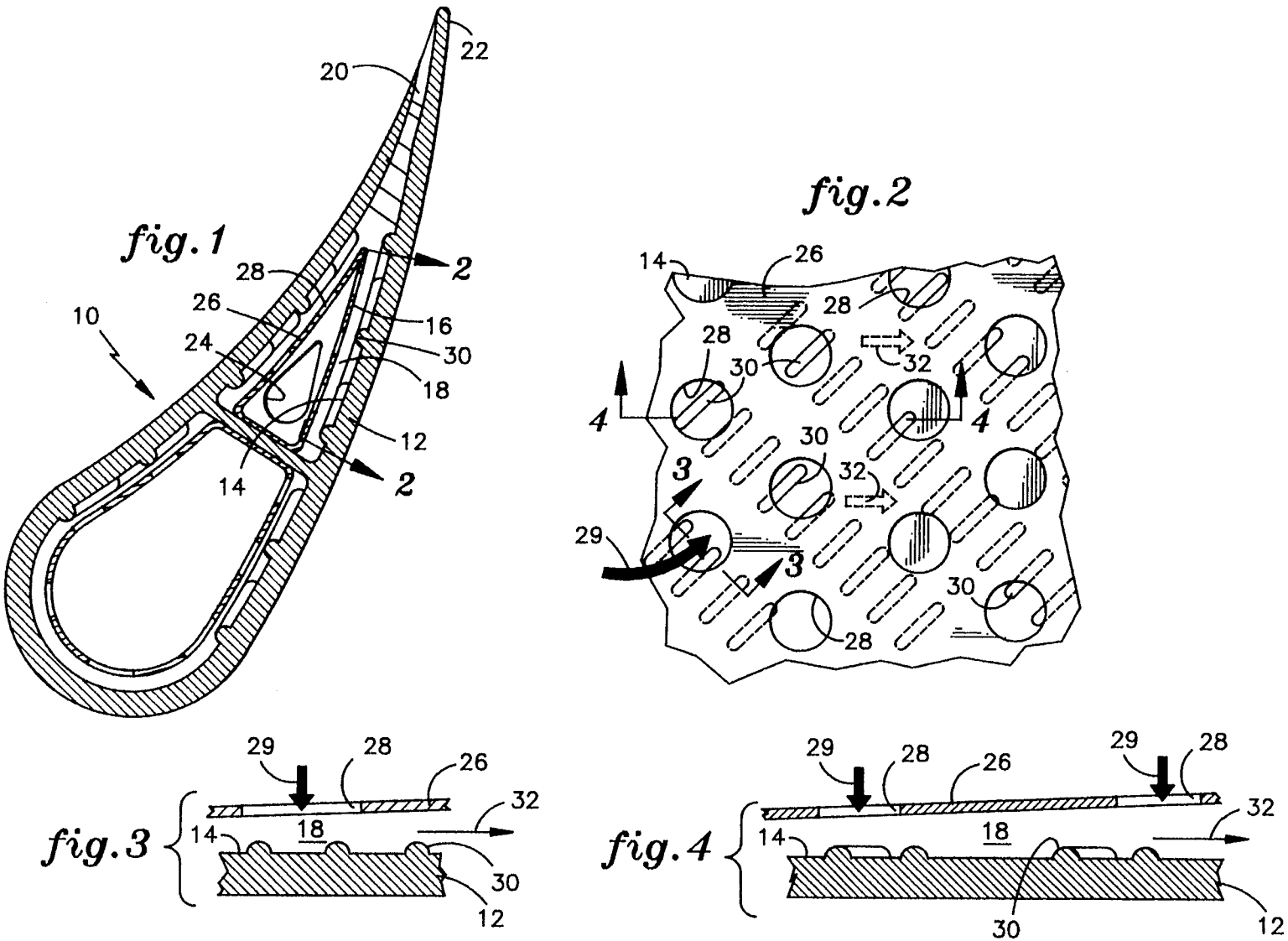
FIG. 1 is a section through the cooled airfoil.
FIG. 2 is view taken along 2—2 showing the impingement openings overlaying the trip strips.
FIG. 3 is a section taken along 3—3 showing a relationship of an opening to the local trip strips.
FIG. 4 is a view taken along section 4—4 showing the tapered airflow chamber.

FIG. 1 shows an airfoil 10 having a wall 12 and an inner surface 14. A hollow tube 16 is located within the airfoil and spaced from the internal surface from the airfoil. Air chamber 18 is thereby formed between the hollow tube and the internal airfoil surface. An air exit 20 is located at the trailing edge 22 of the airfoil with this air exit being in fluid communication with air chamber 18.

An air supplying means 24 located at one end of the airfoil receives air from the compressor discharge has a supply of cooling air for the airfoil. Tube wall 26 has a plurality of flow openings 28 through which cooling air 29 passes impinging against the internal surface 14 of the airfoil.

A plurality of extended surface protrusions 30 are located on the internal surface 14 with the openings 28 through the tube wall 26 being in registration with at least some of the protrusions.

Flow 29 passing through the openings flows toward the exit 20 as illustrated by arrow 32.

The protrusions comprise ribs extending into the flow chamber 18 a distance less than the height of the chamber, permitting the flow to pass thereover. The protrusions are segmented and at an angle of approximately 45° with respect to the direction toward the air exit.

The primary function of these protrusions is to increase the heat transfer surface in the area of the impingement flow. A secondary effect is to improve the turbulence and heat transfer occasioned by the exiting cross flow in areas between the openings.

As shown in FIG. 3 the protrusions 30 are substantially semi-circular bump on the surface 14. In the specific area where the protrusion is located this results in a increased surface are of 50% to 60%. In the overall surface of the general area of the protrusions, a 15% increase is achieved.

FIG. 4 is a section taken along 4—4 of FIG. 2 showing that the flow chamber 18 increases in height from 0.64mm to 1.02mm as flow 32 passes toward the exit. The cumulative flow 32 increases as each impingement flow 29 is added.

The increasing channel height accommodates the accumulated upstream flow and the passage height decrease caused by the start of the extend surfaces array. The height taper minimizes channel pressure drop by providing additional area while optimizing the relationship between impingement and cross flow connection in the flow channel. It increases the uniformity of impingement flows, by decreasing the back pressure against the various upstream openings.

The extended heating surface established by the protrusions is preferably concentrated in registration with, or in the penumbra of the impingement openings. Additional surface in the form of trip strips is desirable at the remote locations.

I claim:

1. A first stage hollow airfoil for a gas turbine comprising:

airfoil walls having an exterior airfoil shape and an internal surface;

a hollow tube located within said airfoil and spaced from said internal surface of said airfoil walls, forming a flow chamber between said tube and said internal surface;

air supply means for supplying cooling air through said hollow tube;

an air exit located at the trailing edge of said airfoil and in fluid communication with said flow chamber;

a plurality of extended surface protrusions on said internal surface; and a plurality of flow openings in said hollow tube in registration with at least some of said protrusions.

2. An airfoil as in claim 1 further comprising:

said hollow tube increasingly spaced from said internal surface towards said air exit.

3. An airfoil as in claim 1 further comprising:

said protrusions comprising ribs extending into said flow chamber a distance less than the height of said chamber;

4. An airfoil as in claim 3 wherein the direction towards said air exit defines an exit direction, comprising:

said protrusions segmented and an angle non-parallel to said exit direction;

5. An airfoil as in claim 4 further comprising said angle being substantially 45°.

6. An airfoil as in claim 3 further comprising:

said hollow tube increasingly spaced from said internal surface towards said air exit.

7. An airfoil as in claim 5 further comprising:

said hollow tube increasingly spaced from said internal surface towards said air exit.

* * * * *